US005454305A

United States Patent [19]

Becker

[11] Patent Number: 5,454,305

[45] Date of Patent: Oct. 3, 1995

[54] HUMAN POWERED CAN FLATTENING MACHINE

[76] Inventor: Mark H. Becker, 1235 Eucalyptus, Vista, Calif. 92084

[21] Appl. No.: 217,367

[22] Filed: Mar. 24, 1994

[51] Int. Cl.[6] ..... B30B 9/32

[52] U.S. Cl. ..... 100/137; 100/282; 100/292

[58] Field of Search ..... 100/137, 282, 100/292, 902

[56] References Cited

U.S. PATENT DOCUMENTS

| | | | |
|---|---|---|---|
| 372,901 | 11/1887 | Ellis | 100/292 |
| 3,832,941 | 9/1974 | Moller | 100/902 |
| 4,291,618 | 9/1981 | Heiser et al. | 100/902 |
| 4,358,994 | 11/1982 | Talley | 100/902 |
| 4,962,701 | 10/1990 | Stralow | 100/902 |
| 5,094,157 | 3/1992 | Challis et al. | 100/137 |
| 5,284,086 | 2/1994 | Wang et al. | 100/902 |

FOREIGN PATENT DOCUMENTS

| | | | |
|---|---|---|---|
| 2011302 | 7/1979 | United Kingdom | 100/902 |

*Primary Examiner*—Stephen F. Gerrity
*Attorney, Agent, or Firm*—Hawes & Fischer

[57] ABSTRACT

The can crusher herein is a pedal, and optionally arm powered, safe, can folding crusher which is vertically hopper fed. An optional flywheel stores mechanical energy during periods of non-maximum power demand to enable the crushing process to proceed with an even application of power. The form of the can folding crusher is that of an exercise bicycle having a horizontal ram which engages cans in a first stroke to prepare the can to be creased into a folded relationship, and in a second stroke in which the folding crushing occurs. The exit chamber is barely the diameter of an adult finger, and is designed to have a length which prohibits both adult and child fingers and hands from reaching any point near the crushing chamber. The feed hopper is adjustable for a variety of lengths of cans, and the seat is adjustable to accommodate a wide variety of human power providers.

17 Claims, 7 Drawing Sheets

HUMAN POWERED CAN FLATTENING MACHINE

FIELD OF THE INVENTION

The present invention relates to the field of devices which reduce the volume of cans, and more specifically, to a human powered can flattening machine which leaves the ends of the can exposed for inspection and is safe to operate.

BACKGROUND OF THE INVENTION

The need to recycle aluminum cans over the past ten years has been responsible for a recycling infrastructure in which a variety of considerations need to be met. In some states, a mandatory fee is charged to the consumer in conjunction with the sale of the can which can be refunded when the can is turned back to the retailer. In other states, the recycling function is governed solely by the weight of the returned cans and the price for scrap aluminum. Other mechanisms for the return of aluminum cans include machines in which a can is deposited and within which the bar code is read to determine both the number and type of cans turned in before automatically paying the customer.

In instances where cans are purchased because of their weight, the crushing of the can will assist in having a storage mass of considerably less volume for a given weight. Because of this advantage, a myriad of can crushing devices have found their way onto the market. Of these, some are safer than others. Some can crushers are industrial strength, massively powered and intended to perform bulk crushing of a high volume of cans. This type of application is ideal for situations where the cans may be rapidly and continuously fed without much starting and stopping which would be present at the point of sale. After crushing, and particularly with the larger machines, the identity of the can may be undiscernible. In fact, where the crushing is particularly violent, the portion of the can having writing and the end portions may be partially shredded.

At the other end of the spectrum is the manual crusher. This item is usually hand fed a single can at a time, and may require both arms to crush the can. Usually a lever is employed to give mechanical advantage. The can's lid is usually laterally partially crushed along with the body. The volume reduction will usually not be as great as that achievable with the large electrically powered machines. In both instances, however, the ends of the cans are deformed, which may not present a problem where the cans are sold based upon weight.

In the case of pre-sale crushing of cans, it may be desirable to carefully crush the cans so as to leave the ends intact for several reasons. First, the ends are usually made of thicker material than the can's side. If a choice between two materials is to be made with regard to which will be folded, the folding of the thicker material will yield a larger internal airspace, for a given amount of crushing energy.

Second, the end portions may carry information, impressed at the time of the can's formation, relating to the can's refund amount. More specifically the inforation may include the state within the United States, or country with which the can was designated at the time the can was formed. Some states have a higher refund amount than other states, and typically the states with the higher refund amounts will also carry a state identification which has to match with the locale of the facility at which it is being returned, usually a grocery store. This problem can be especially keen in communities located near state borders where the cross-flow of cans from one jurisdiction to another is very likely.

The third problem relates back to the problem of identification of the type of can. If a can is crushed, it will likely be impossible to tell the size of the can, unless the volume label is present and can be read. Most crushing, even where the crushed can product is generally of a uniform type, leaves the can in a condition where it is impossible to readily ascertain its volume.

A fourth problem relates to the energy for crushing cans. In most crusher configurations, the crushing is a partial crushing, or where an attempt is made to insure that the can is identifiable, there is usually a tradeoff between identifiability of the can and the amount of crushing applied. In the case of human powered, or manual can crushers, the degree to which the cans are crushed is depend upon the playoff between two factors, simplicity and applied power. Since the human power input from a simple machine is limited, a simple lever type machine will be limited in the amount of crushing power which the can may receive. Where more power is sought to be applied to the can, further mechanics can be employed. These further mechanics increase the complexity of the can crusher, and the power which can be applied to the can.

A major consideration is can crusher safety. If the crushing chamber can be accessed by the human limbs and digits, the potential for serious injury will be present. Where manual crushers are configured to increase the application of power to the crushing chamber, and such chamber is accessible to the fingers and hands, the potential for injury is high.

A further problem with manual crushers is the time and energy application of power to the crushing process. Most manual crushers require the operator to perform a two-step process. In one step, requiring little or no energy, the can is loaded into the crusher. In the second step, human power is applied to crushing chamber. The energy capacity of the human during the loading step is under utilized. Further, most manual crushers are hand and arm powered, rather than foot and leg powered. A larger supply of power can be derived from the latter than the former.

One electrically powered attempt at foldably crushing cans is described in U.S. Pat. No. 4,291,618 to Warren R. Heiser and entitled "Method and Apparatus for Folding and Crushing Empty Cylindrical Cans." The configuration there involved a zig-zag hopper feeding a chamber having a complex ram set in which a center ram operated in coordination with a following central ram. A complex set of gears and levers processes each can with a two step motion in the chamber. A set of fingers are used to hold the can during the dual action crushing process.

In this configuration, however, the can exit chute is not long enough nor narrow enough to preclude an operator from inserting fingers and hands into the chute. Such an accident may occur if a can becomes trapped in the chute or upon the complex fingers which hold the can in place. In the above mentioned machine there is no easy, safe way to clear the crushing chamber and exit chute. This is particularly dangerous in an electric powered device, and virtually precludes the possibility of operation by children and young adults due to the danger potential.

SUMMARY OF THE INVENTION

The can crusher of the present invention is a pedal powered, optionally hand crank assisted, safe, can folding crusher which is vertically hopper fed. An optional flywheel stores mechanical energy during periods of non-maximum power demand to enable the crushing process to proceed with an even application of power.

The form of the can folding crusher of the present invention is that of an exercise bicycle having a horizontal ram which engages cans in a first stroke to prepare the can to be crushed into a folded relationship, and in a second stroke in which the folding crushing occurs. The exit chamber is barely the diameter of an adult finger, and is designed to have a length which prohibits both adult and child fingers and hands from reaching any point near the crushing chamber.

The feed hopper is adjustable for a variety of lengths of cans, and the seat is adjustable to accommodate a wide variety of human power providers.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENT

Figure 1:
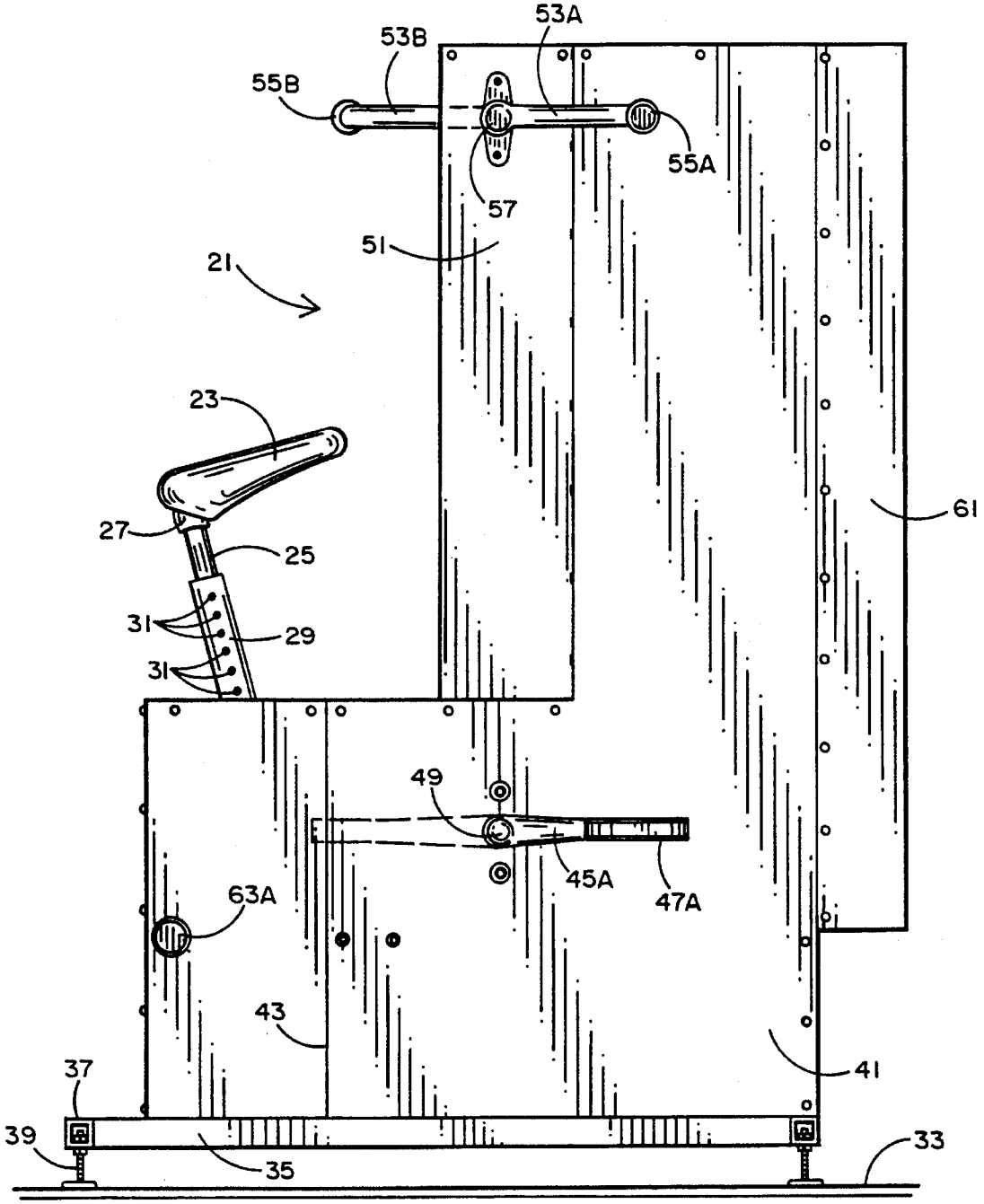
FIG. 1 is a side view of the can crusher of the present invention.

The description and operation of the invention will be initiated with reference to FIG. 1. FIG. 1 clearly shows a can crusher 21 in a configuration similar to that of an exercise machine. A seat 23 is supported on a tubular seat support 25 by means of a bracket 27. Tubular seat support 25 is received in a height adjustment support tube 29 having a series of apertures 31 which permit seat 23 and its support structures to be secured at varying heights with a pin or button or other securing structure operable in conjunction with the apertures 31.

Can crusher 21 may be supported on a flat surface 33 by a horizontal support, including a central support 35 and extending leg supports 37. The extending leg supports 37 include threaded adjustable height pads 39 which are threadably received into the leg supports 37.

Can crusher 21 includes a main housing 41 having a shallow angled transition 43 as it extends rearwardly under the seat 23. A foot pedal crank 45A extends outwardly of the main housing 41 and includes a foot pedal 47A. The foot pedal crank 45A revolves about a main shaft 49.

A detachable upper rear panel section 51 lies upward and to the rear of main housing 41. A hand crank 53A extends outwardly of the rear panel section 51 and includes a handle 55A. The hand crank 53A revolves about a shaft 57.

The cranks and pedals described being right-side hand crank 53A and foot pedal crank 45A, a portion of the left-side hand crank 53B and handle 55B is also seen. Note that the orientation of the crank 45A and the hand crank 53A are both horizontal, indicating that these two structures may be made to be rotationally in synchronization. Slippage clutch mechanisms may be employed to enable the synchronization to be adjusted by the user, although they are not employed in this configuration.

At the front of the can crusher 21, a vertical can processing housing 61 can be seen. This structure forms a vertical can feed, leading down into a first area where the can will be creased, and into a second area where it will be folded. A step up support 63A can also be seen vertically beneath the seat 23, which may be used by riders to mount the seat 23.

Figure 2:
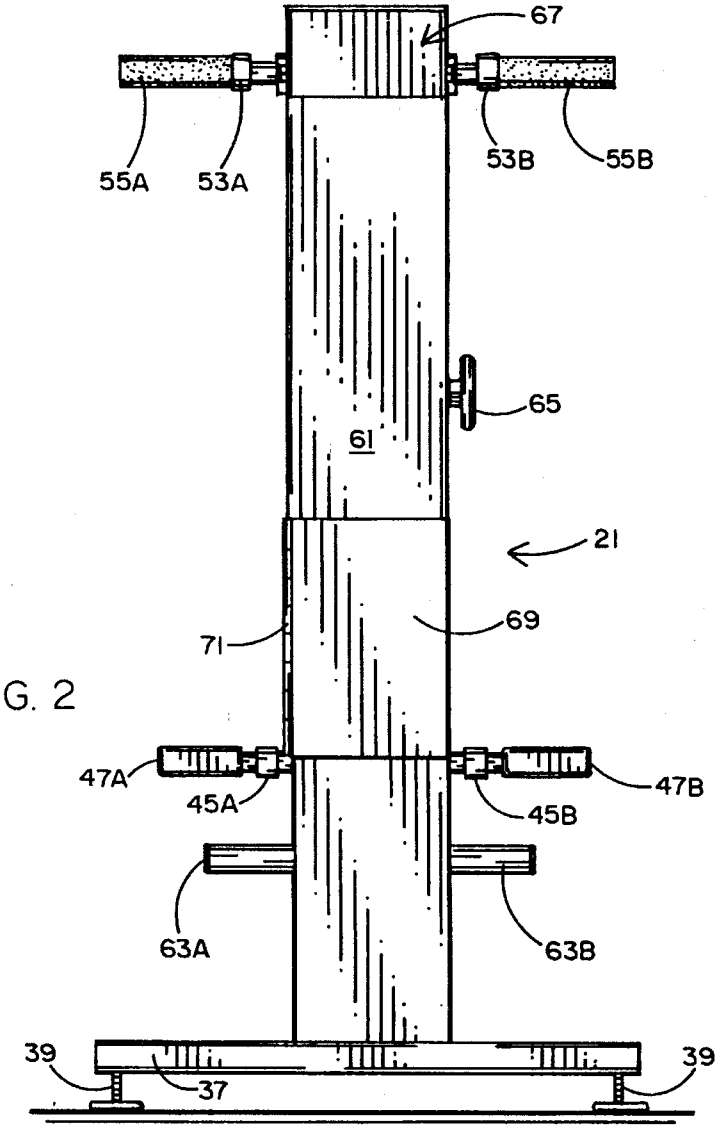
FIG. 2 is a front view of the can crusher shown in FIG. 1 with its compaction chamber in the closed position.

Referring to FIG. 2, a front view better illustrates many of the structures seen in FIG. 1. In addition, a width adjustment handle 65 can be seen on the left side of the can crusher 21. The handle 65 enables adjustment for cans of various heights to be received into the crusher 21, and engages a lead screw (not yet shown). At the upper portion of the view of FIG. 2, the vertical can processing housing 61 can be seen to have a feed opening 67.

The vertical can processing housing 61 also has a reinforced door 69 secured to the vertical can processing housing 61 by a hinge 71. The other side of door 69 may be secured to vertical can processing housing by any suitable means sufficient to withstand the forces which will be impressed upon it including another hinge, or other closure mechanism. The cans which are fed into the feed opening 67, after making their way down to the vicinity of the door 69, will be successively creased, and then folded against the door 69. The hinge 71 will enable the door 69 to open, giving full access to the area in which cans are creased and folded, or foldably crushed.

Figure 3:
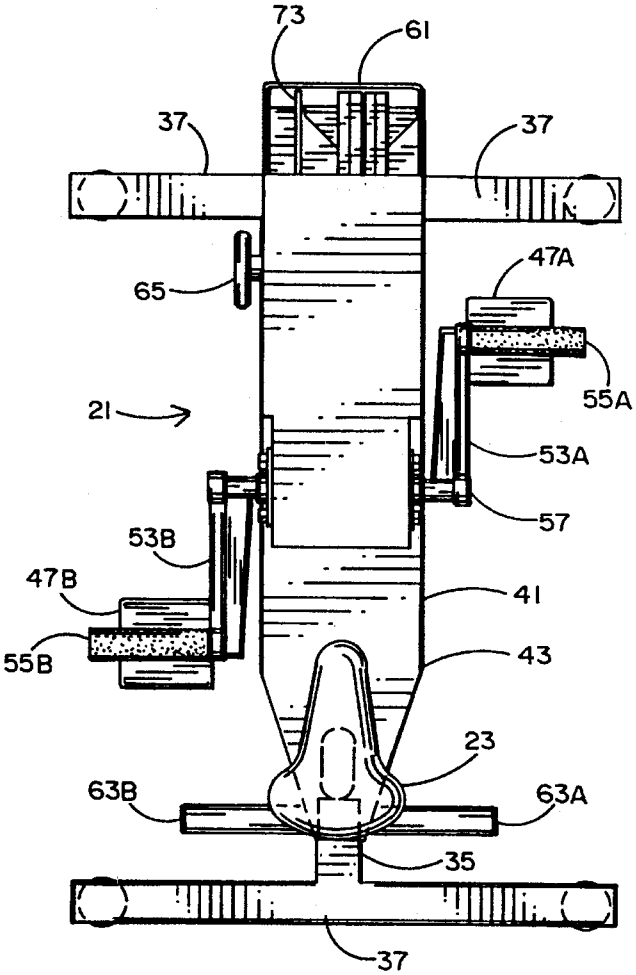
FIG. 3 is a top view of the can crusher shown in FIGS. 1 and 2 with the vertical can feed hopper shown in open section.

FIG. 3 looks down on the crusher 21 and illustrates again many of the structures previously seen in FIGS. 1 and 2. In addition, a partial section is provided at the top of the vertical can processing housing 61 to give a partial view of an internal wall 73 which is moveable to adjust the height of cans which can be received in the vertical can processing housing 61.

Figure 4:
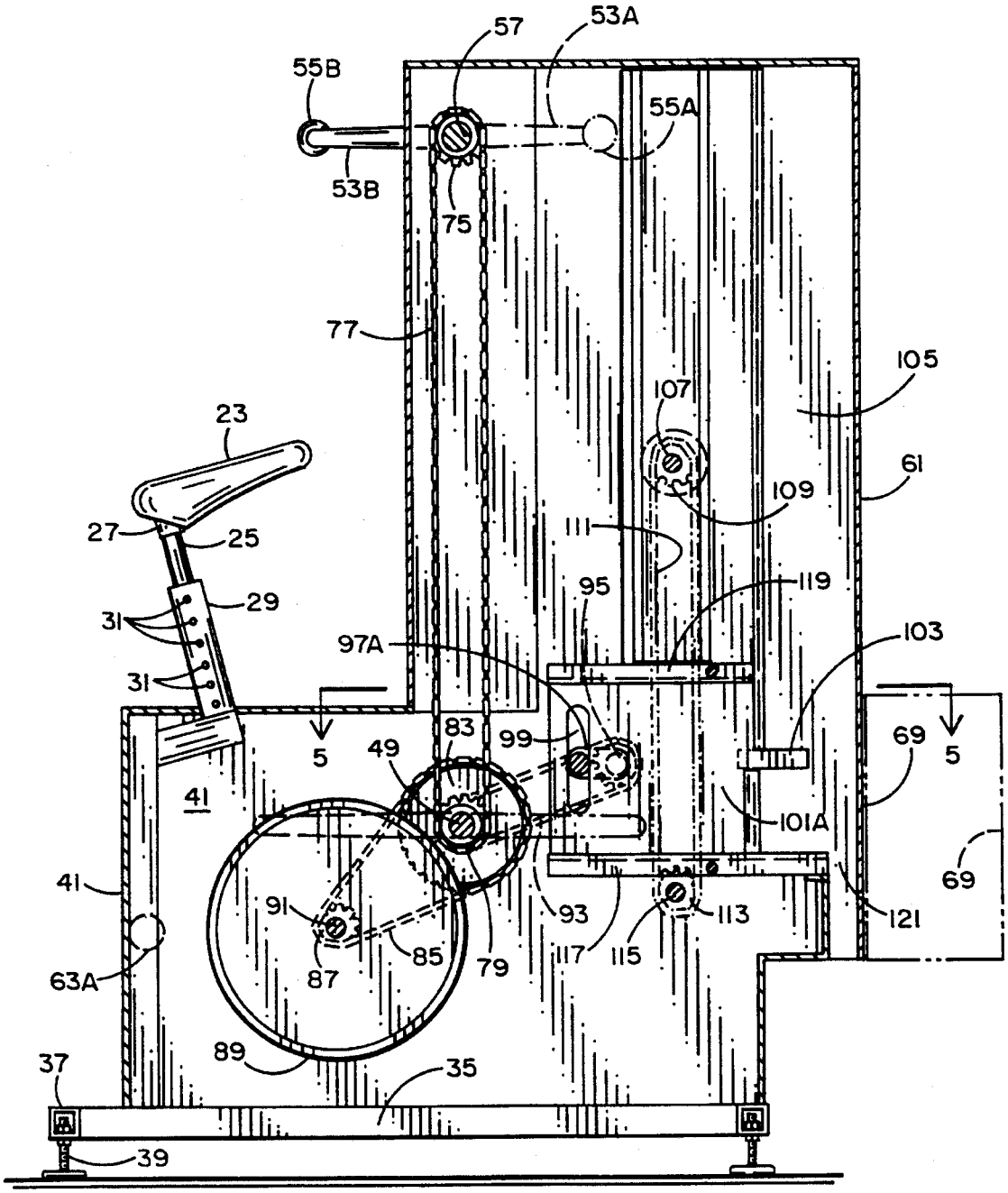
FIG. 4 is a side sectional view of the can crusher shown in FIGS. 1–3 and illustrating the mechanical drive with the vertical can feed hopper shown in open section.

Referring to FIG. 4, an overall sectional view illustrates the basic mechanical connections and components in the can crusher 21. Shaft 57 can be seen to have a small sprocket 75 supporting a vertical chain 77. Chain 77 extends to a small sprocket 79 which engages main shaft 49. It is through these structures that power from the hand crank 55 is transmitted to the main shaft 49.

Main shaft 49 also supports a large sprocket 83 supporting a chain 85 which extends to a flywheel sprocket 87 which rotatably connects with a flywheel 89 on a flywheel shaft 91. The flywheel system described herein is optional, because in most cases, sufficient power may be obtained from the foot pedal cranks 45 and the hand cranks 55, to foldably crush cans. An overrunning clutch may be employed to enable the flywheel 89 to spin without the necessity for the human actuated structures to continue movement. Also the flywheel 89 may be omitted where it is desirable for the operator to "feel" the cans crush during the power cycle. It has been experienced that the flywheel system thus described does such a good job of leveling the power required to crush cans, that the crushing action can scarcely be felt by the can crusher 21's human power provider.

Also from the main shaft 49, a crusher drive chain 93 is driven by a sprocket (not yet shown) to drive the crusher crank shaft 95. Crusher crank shaft 95 turns a pair of cranks 97 (only 97B is visible) which engage slots 99 on a pair of slide plates 101, (of which plate 101B is visible). Turning of the crusher crank shaft 95 causes the slide plates 101 to move forward and rearward to provide the crushing motion, which is a simple harmonic motion.

Also shown in FIG. 4 is a permanently mounted stop 103 within the vertical feed space 105 of vertical can processing housing 61. Cans which have not been creased cannot pass this point. The area immediately above stop 103 is the area at which the can creasing occurs, while the area beneath the stop 103 is the area where the final and complete foldable crushing of the cans occurs.

Also shown are the structures which relate to the width adjustment handle 65. The width adjustment handle is attached to an upper lead screw 107. Upper lead screw 107 engages an upper lead screw sprocket 109 which is attached to a vertically looped chain 111. Chain 111 is similarly attached to a lower lead screw sprocket 113 which is attached to a lower lead screw 115. In this manner, the mechanism for crushing cans, particularly the internal wall 73 previously referred to, can be adjusted to accommodate cans of different heights. Since the cans are fed into the crusher 21 horizontally, the changing height of the can translates into the need for a width of changing magnitude for the crusher 21.

The upper and lower lead screws 107 and 115 act to change and set the width of the crushing portion of the apparatus, including internal wall 73, at two heights to prevent "binding" of the portions of the mechanism which slide. The chain 111 not only sets the timing of the two lead screws 107 and 115 in phase, but enables the energy with which the upper lead screw 107 is turned, to be transmitted to the lower lead screw 115.

As can also be seen in FIG. 4, the slide plates 101 slide upon and are bound by a lower slide block 117, and are bound upwardly by an upper slide block 119. Note that the lower slide block 117 extends into the vertical feed space 105, and forms a portion of the exit chute 121 with respect to the reinforced door 69. Reinforced door 69 is also shown in dashed line format in the open position. As can be seen, the crushed can must be of small depth to slide downward through the exit chute 121. Further, the exit chute 121 is sufficiently long and narrow that neither a child's hand nor an adult's fingers can fit wholly upwardly into the exit chute 121.

Given that an aluminum soft drink can is a little over two and a half inches in diameter, it can be readily seen that the exit chute 121 is so much significantly smaller than the vertical feed space 105 that neither adult fingers nor children's hands can reach the portion of the vertical feed space 105 which is the crushing area below the stop 103 where the crushing takes place.

Figure 5:
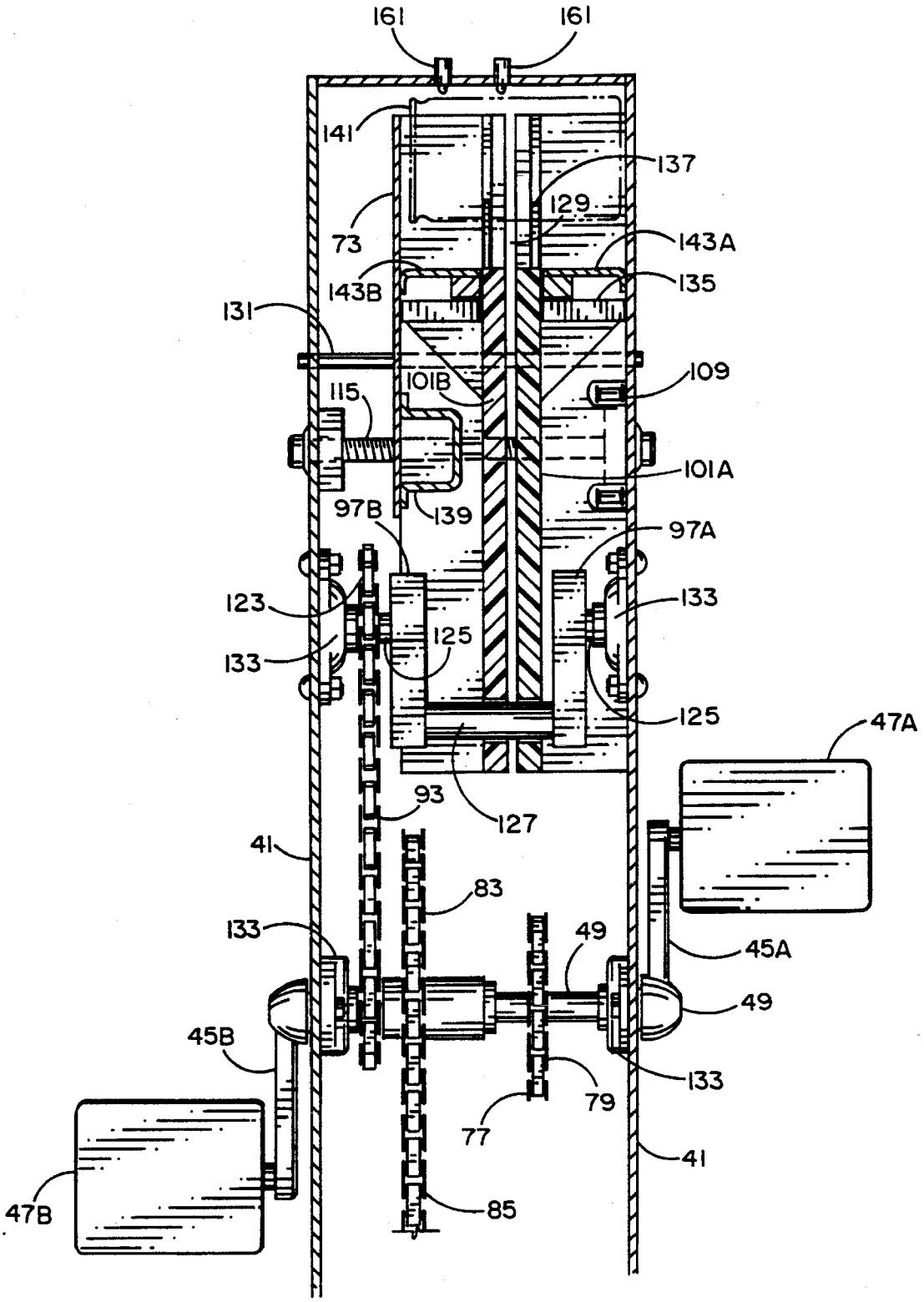
FIG. 5 is a top sectional view illustrating certain portions of the drive mechanism of the can crusher shown in FIGS. 1–4 in a retracted position.

FIG. 5 is a sectional view about line 5—5 of FIG. 4, looking downwardly into the operational portion of the can crushing mechanism. In FIG. 5, the slide plates 101 and therefore the crushing mechanism is in retracted position. A sprocket 123 is shown between chain 93 and one of a pair of outer crank shafts 125 engaging the cranks 97. A bearing shaft 127 connects the ends of the cranks 97 and provides a surface to support engagement with slots 99 on slide plates 101. A brass bearing or other bearing structure may surround bearing shaft 127 to provide an interstitial bearing member for engagement with the slots 99.

Note that the crushing mechanism has bilateral symmetry, separated by a gap 129. The gap 129 widens when the adjustment handle 65 is adjusted for taller cans and narrows when adjusted for shorter cans. Also note that the main housing 41 forms the right side support structure for the crushing mechanism, while the abbreviated length internal wall 73 supports the sliding portions of the crushing mechanism on the left side.

A support rod 131 is visible which slidably supports the left side of the mechanism shown in FIG. 5, including the lower left slide block 117B (not shown in FIG. 5), the left slide plate 101B, and upper left slide block 119B, (also not shown in FIG. 5). Support rod 131 also supports the right side of the mechanism shown in FIG. 5, but not slidably, since it is laterally fixed with respect to the right side of the main housing 41.

Various shafts are shown as held in place against portions of the main housing 41, usually with a flange pillow block bearing 133, preferably of the two bolt variety. The end face 135 and creasing anvil 137 are shown supported by the slide plates 101. The anvil 137 is located above the stop 103, while the end face 135 is located below stop 103.

A lower channel bracket 139 engages the lower left slide block 117B and is similar to an upper channel bracket (not shown) which engages the upper left slide block 119B. These brackets are threaded and threadably engage the upper and lower lead screws 107 and 115 and provide the support and urging movement of the left side of the crushing mechanism. A can 141 is shown in phantom adjacent the end face 135. This is the position which the cans 141 will assume when fed into the can crusher 21. Also shown are a pair of support plates 143 which partially bear against the slide plates 101 to guide and allow the slide plates to have forward and rearward can-crushing motion.

Figure 6:
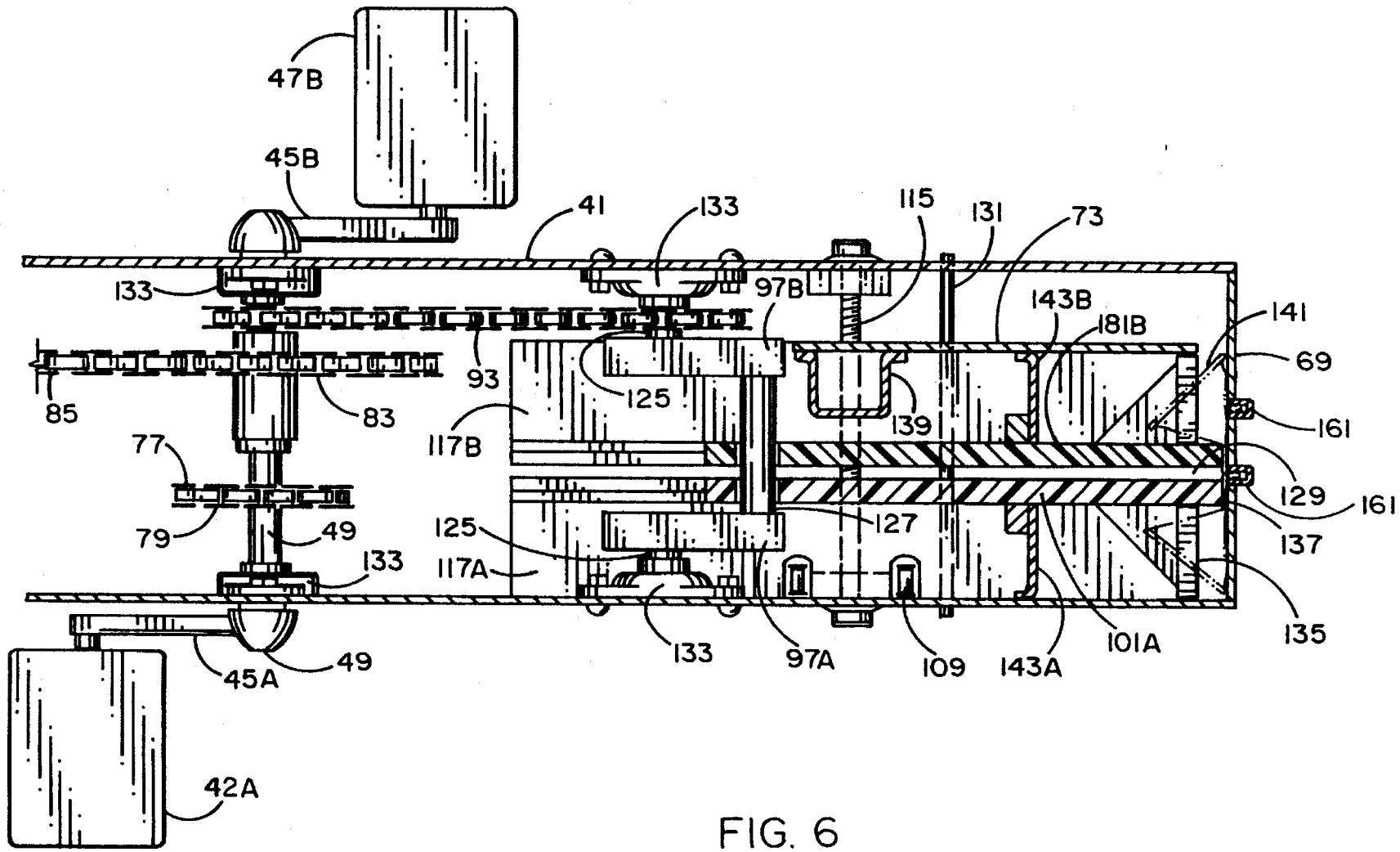
FIG. 6 is a top sectional view as in FIG. 5, but showing the portions of the drive mechanism of the can crusher in a forward, crushing position.

Referring to FIG. 6, the foot pedal crank 45 has been rotated 180°, the slide plates 101 urged to the forward position. The can 141 is shown in the creased position, due to its engagement with the anvil 137, but before engagement with end face 135. Note the change in position of the cranks 97.

Figure 7:
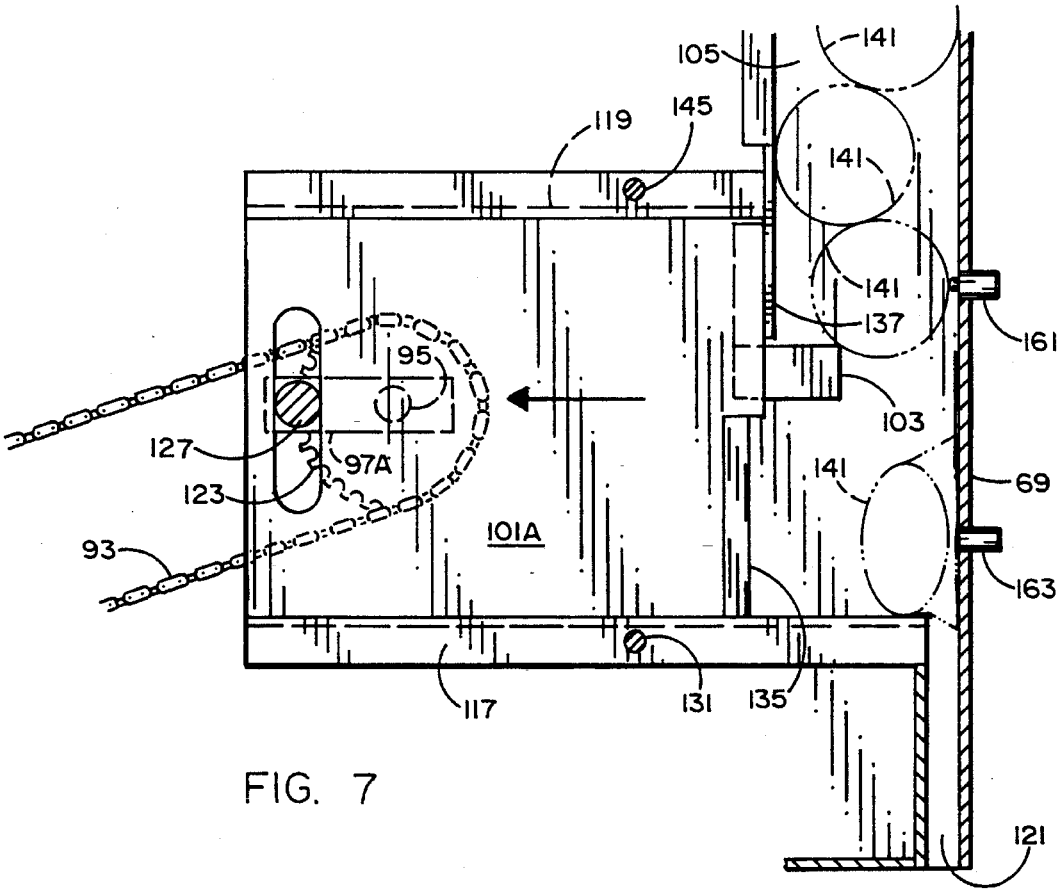
FIG. 7 is an isolated expanded view illustrating the positions of cans a first can is in position for creasing in an upper space while a second can is readied for foldable crushing in a lower space.
Figure 8:
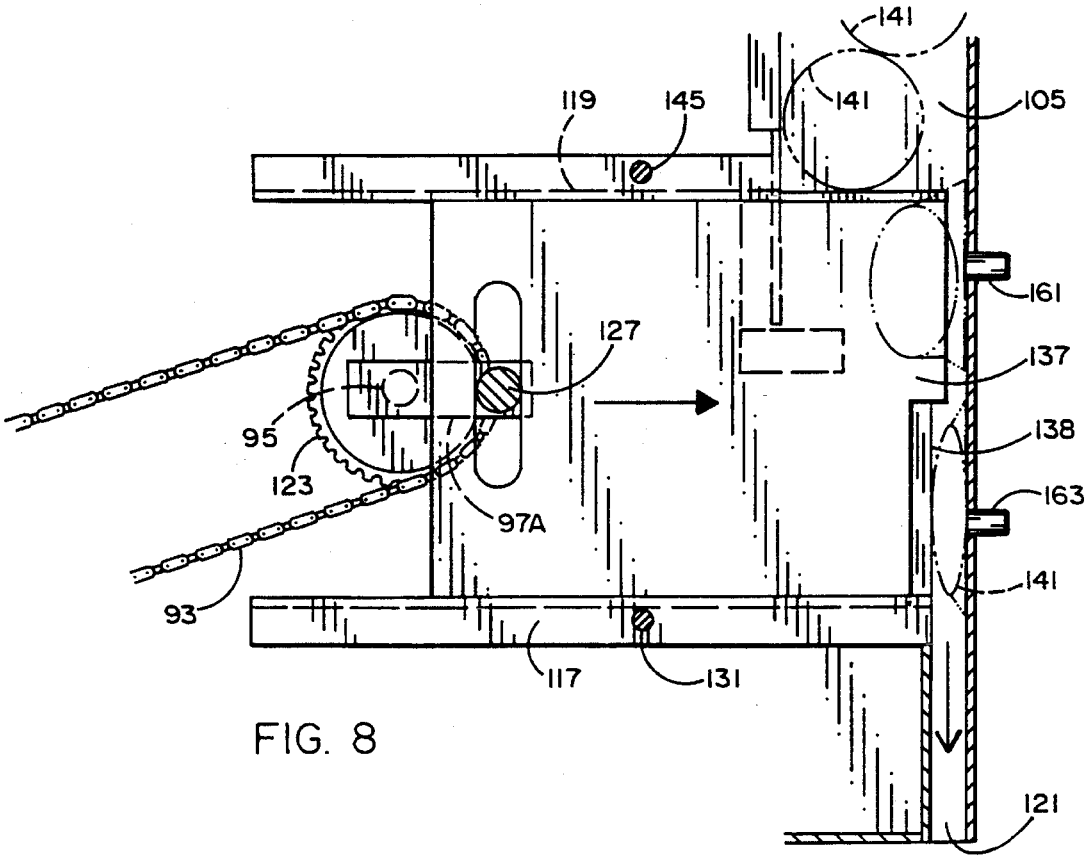
FIG. 8 is an isolated expanded view illustrating the creasing of the first can in the upper space while the second can is crushed in a lower space.

FIGS. 7 and 8 are isolated expanded views illustrating the crushing of cans 141 as appearing from a side view 123. Now can be seen illustrated the positions of cans 141 as they are fed through the can crusher 21. The upper support rod 145 can now be seen supporting the upper slide block 119.

The lower of the whole, un-deformed cans 141 in FIG. 7 is supported against stop 103, and cannot pass because the space between the tip end of stop 103 and the reinforced door 69 is not sufficient to enable the whole can 141 to drop.

The lowest can 141, which was creased or deformed slightly during the last compression stroke is shown with its ends turned away from the viewer, and as it sits in the crushing chamber awaiting folded flattening during the next crushing stroke. If it were not creased, it could not fall below the stop 103.

Note that the cranks 97 are in a position urging the slide plates 101 rearwardly, away from the cans 141 and the reinforced door 69. The energy for the movement of the slide plates 101, end face 135 and anvil 137 is via the chain 93 and its associated sprockets and shafts.

Referring to FIG. 8, the slide plates 101, end face 135 and anvil 137 have been brought into crushing position. The lowest can 141 which was shown in FIG. 7 as partially deformed and creased, has now been crushed as a result of the direct action of the end face 135 against the inside surface of the reinforced door 69. The can 141 of FIG. 7 which was un-deformed has now been creased and partially deformed by the action of the anvil 137 against the inside surface of the reinforced door 69. This can waits for the withdrawal of the anvil 137 so that it may fall past the stop 103 and into the lower area. The can in the lower area which has just been crushed by the direct action of the end face 135 against the inside surface of the reinforced door 69, awaits the withdrawal of the end face 135 so that it may fall through the exit chute 121.

Figure 9:
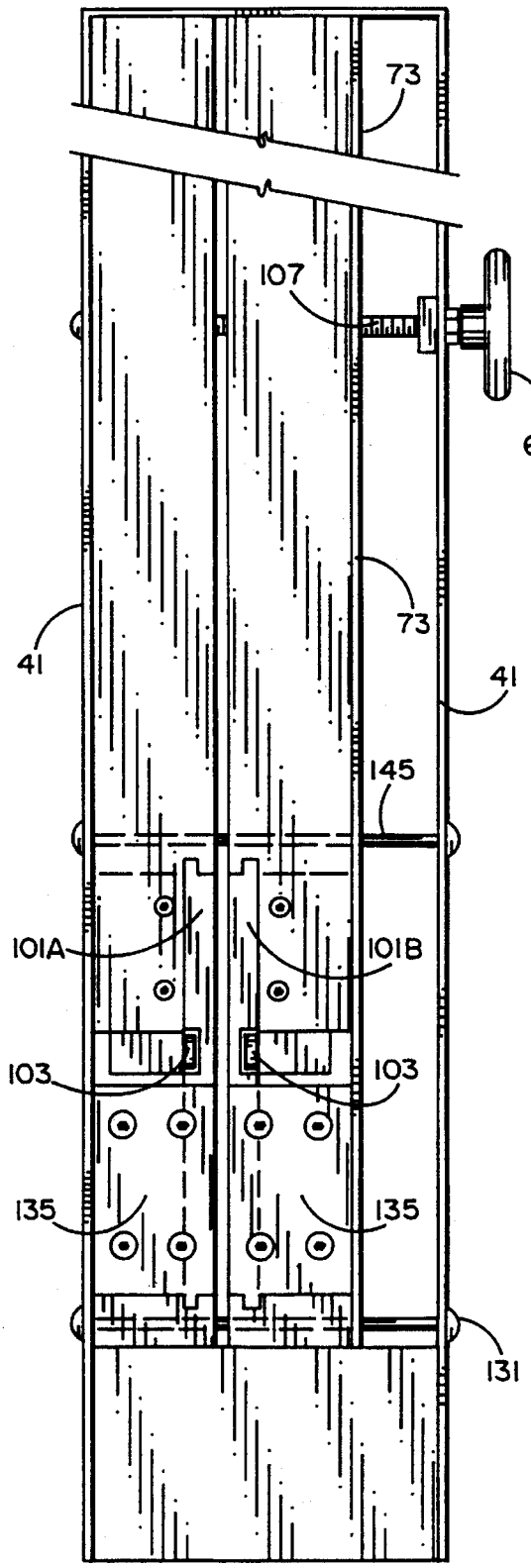
FIG. 9 is a front view of the can crusher illustrating the internal wall and set for crushing a short can.

As can be seen in both FIG. 8 and in FIG. 9, an optional set of spring plungers may be employed, namely upper spring plunger set 161 and lower spring plunger set 163, to prevent the cans 141 from sticking against the reinforced door 69. The spring plunger sets 161 and 163 will typically be round nosed plungers which may be set in bosses to give adequate structural support for mounting.

Figure 10:
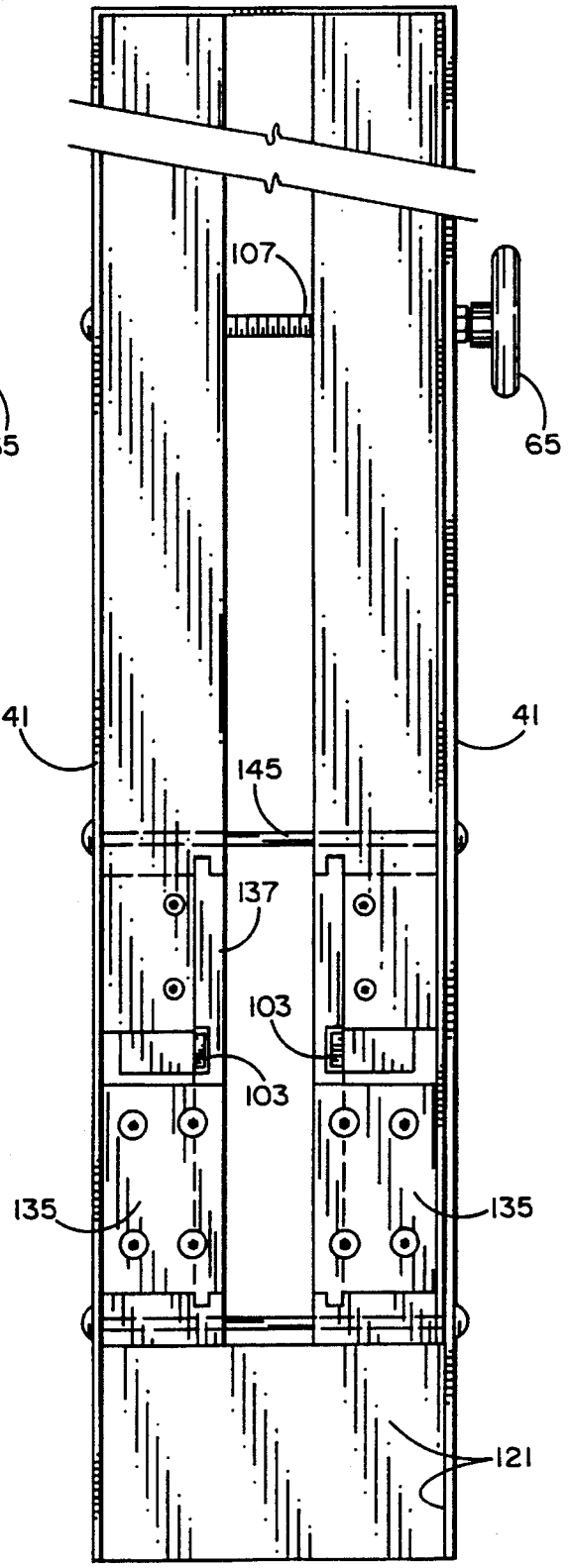
FIG. 10 is a front view of the can crusher illustrating the internal wall and set for crushing a long can.

Referring to FIGS. 9 and 10, the front of the can crusher, with the vertical can processing housing removed illustrates the action by which tall and short cans 141 may be accommodated. Prominent is the internal wall 73. FIG. 9 illustrates the can crusher 21 in its most narrow position. The internal wall 73 is furthest from the main housing 41 to which it is most adjacent. The slide plates 101 are close together, as are the end faces 135, and the stops 103. FIG. 10 illustrates the can crusher 21 in its most wide position. The internal wall 73 is now nearest to the main housing 41. The slide plates 101 are far apart, as are the end faces 135, and the stops 103.

Exit chute 121 is shown. The view from about the height of the upper support rod 145 to the bottom of the exit chute is the same as would be had from the front of the can crusher 21 with the reinforced door 69 in the open position. As can be seen the opening of the reinforced door frees the front portion of the crushing mechanism. Any can 141 which is caught will either fall away instantly, once reinforced door 69 is opened, if it is hung on either the end face 135 or any of the exit chute 121's surfaces. Any can 141 which may be caught on the stops 103 can be pulled directly off. Cans 141 above the stops 103 will simply fall away.

While the present invention has been described in terms of a human powered folding can crusher, one skilled in the art will realize that the structure and techniques of the present invention can be applied to many appliances. The present invention may be applied in any situation where a one or two step process with a feed is needed to ensure a completely processed, completely flattened product, without the concomitant safety risks of a high powered electric crusher.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

For example, by way of illustration and not limitation, since the can crusher 21 may be operated with or without the crushing of cans, the structures of the present invention could be connected to a generator to power a television, radio, or lighting device so that the rider can get a sense of his power output. A friction band may be placed on the flywheel to increase the amount of exertion required to operate the can crusher 21.

What is claimed:

1. A human powered can crusher comprising:

sliding means fixably supporting an anvil and an end surface, for simultaneously translating said anvil and said end surface in the same direction under the influence of human power;

opposition means, located opposite said anvil and said end surface, for providing a surface with which said anvil may crease objects and said end surface may crush objects, and which may be pivoted to an open position away from its opposing position with respect to said anvil and said end surface, said sliding means and said opposition means commonly supported; and stop means, interposed between said anvil and said end surface, for providing a fixed clearance with respect to said opposition means.

2. The human powered can crusher recited in claim 1 wherein said sliding means and said opposition means form an enclosed can processing chamber having an upper creasing chamber and a lower crushing chamber.

3. The human powered can crusher recited in claim 2 and further comprising a vertical can processing housing having a vertical feed space, having an opening, located over said upper creasing chamber.

4. The human powered can crusher system of claim 3 wherein said can crusher has a laterally adjustable internal wall within said vertical can processing housing to enable the width of the vertical feed space located over said upper creasing chamber to be preselectably adjustable.

5. The human powered can crusher recited in claim 2 further comprising an exit chute located under said lower crushing chamber, said exit chute having a width and length combination insufficient to enable the hands and fingers of and adult and child to reach to said crushing chamber.

6. A human powered can crusher comprising:

sliding means fixably supporting an anvil and an end surface, for translating said anvil and said end surface under the influence of human power and further comprising:

at least one slide plate, slidably supported by a slide block, and supporting said anvil and said end surface, said slide plate defining a cam slot;

a cam bearing shaft, having a first end and a second end, and engaging said cam slot;

at least a first camcrank engaging one of said first and said second ends of said cam bearing shaft;

a cam shaft, connected to said at least a first cam crank, and rotatable about a fixed point;

a main support;

a main housing supported by said main support and providing support to said cam shaft; and power input means, connected to said cam shaft, for inputting human power to said at least a first cam crank;

opposition means, located opposite said anvil and said end surface, for providing a surface with which said anvil may crease objects and said end surface may crush objects, said sliding means and said opposition means commonly supported; and stop means, interposed between said anvil and said end surface, for providing a fixed clearance with respect to said opposition means.

7. The human powered can crusher recited in claim 6 and further comprising human support means, supported by said main support, for supporting the human body during the input of human energy.

8. The human powered can crusher recited in claim 6 wherein said power input means further comprises:

a cam shaft sprocket surrounding said cam shaft;

a foot pedal shaft, supported by said housing;

a foot pedal crank, supported by said foot pedal shaft;

a foot pedal sprocket carried by said foot pedal shaft; and a foot pedal chain connected between said foot pedal sprocket and said cam shaft sprocket.

9. The human powered can crusher system of claim 8 wherein said foot pedal sprocket engages said foot pedal shaft when urged in a first direction and slips freely about said foot pedal shaft when urged in a second direction.

10. The human powered can crusher recited in claim 8 wherein said power input means further comprises:

a hand crank foot pedal shaft sprocket surrounding said foot pedal shaft;

a hand crank shaft, supported by said housing;

a hand pedal crank, supported by said hand crank shaft;

a hand crank sprocket carried by said hand crank shaft; and a hand crank chain connected between said hand crank sprocket and said hand crank foot pedal shaft sprocket.

11. The human powered can crusher system of claim 10 wherein hand crank foot pedal shaft sprocket engages said foot pedal shaft when urged in a first direction and slips freely about said foot pedal shaft when urged in a second direction.

12. The human powered can crusher system of claim 8 and further comprising:

a flywheel foot pedal shaft sprocket surrounding and rotatable with said food pedal shaft;

a flywheel shaft rotatably supported by said main housing;

a flywheel rotatably supported by said flywheel shaft;

a flywheel sprocket rotatable with said flywheel shaft; and a flywheel chain connected between said flywheel sprocket and said flywheel foot pedal shaft sprocket.

13. A human powered can crusher comprising:

sliding means fixably supporting an anvil and an end surface, for translating said anvil and said end surface under the influence of human power;

opposition means, located opposite said anvil and said end surface, for providing a surface with which said anvil may crease objects and said end surface may crush objects, said sliding means and said opposition means commonly supported;

stop means, interposed between said anvil and said end surface, for providing a fixed clearance with respect to said opposition means, and wherein said sliding means and said opposition means form an enclosed can processing chamber having an upper creasing chamber and a lower crushing chamber and;

a vertical can processing housing having a vertical feed space, having an opening, located over said upper creasing chamber, and wherein said can crusher has a laterally adjustable internal wall within said vertical can processing housing to enable the width of the vertical feed space located over said upper creasing chamber to be preselectably adjustable, and wherein said laterally adjustable internal wall is laterally and supportably adjusted from at least two synchronized lead screws.

14. A human powered can crusher comprising:

a main support;

a main housing supported by and at least partially surrounding said main support;

human power input means, supported by said main housing and said main support, for facilitating the inputting of human power;

horizontally moveable block defining an end surface and an anvil overlying said end surface, and forcibly movably powered by said human power input means;

a processing chamber having an upper creasing sub-chamber at least partially separate from a lower crushing sub-chamber, said processing chamber having an inlet, and wherein said processing chamber is accessible by a door.

15. The human powered can crusher as recited in claim 14 further comprising stop means, between said creasing sub-chamber and said crushing sub-chamber, for enabling the entry of only articles which have been creased into said crushing sub-chamber.

16. A human powered can crusher comprising:

a main support;

a main housing supported by and at least partially surrounding said main support;

human power input means, supported by said main housing and said main support, for facilitating the inputting of human power;

horizontally moveable block defining an end surface and an anvil overlying said end surface, and forcibly movably powered by said human power input means;

a processing chamber having an upper creasing sub-chamber at least partially separate from a lower crushing sub-chamber, said processing chamber having an inlet, and wherein the width of said processing chamber, including said creasing sub-chamber and said crushing sub-chamber are selectably continuously adjustable.

17. A human powered can crusher comprising:

a main support;

a main housing supported by and at least partially surrounding said main support;

a main pedal shaft assembly, supported by said main housing and said main support;

a seat supported by said main support;

a slide block assembly supporting an end face and an anvil surface overlying said end face a vertical can feed housing having an adjustable width and a reinforced surface;

a cam assembly to facilitate translation of human power from said main pedal shaft assembly into horizontal motion of said slide block assembly into and away from the reinforced surface defining a portion of a creasing chamber and an overlying a crushing chamber;

a stop, interposed between said creasing chamber and said crushing chamber, said stop forming a clearance with respect to said reinforced surface.

* * * * *